US006840870B1

(12) United States Patent
Froggatte

(10) Patent No.: US 6,840,870 B1
(45) Date of Patent: Jan. 11, 2005

(54) ALIGNMENT GUIDE FOR PRACTICE PUTTING

(76) Inventor: Samuel D. Froggatte, 1380 Woodmoor Dr., Monument, CO (US) 80132

( * ) Notice: Subject to any disclaimer, the term of this patent is extended or adjusted under 35 U.S.C. 154(b) by 0 days.

(21) Appl. No.: 10/349,301

(22) Filed: Jan. 22, 2003

(51) Int. Cl.[7] ..... A63B 69/36
(52) U.S. Cl. ..... 473/265; 473/261
(58) Field of Search ..... 473/261, 262, 473/263, 264, 265, 266, 267, 268, 278, 279

(56) References Cited

U.S. PATENT DOCUMENTS

| | | | | | |
|---|---|---|---|---|---|
| 2,992,005 | A | * | 7/1961 | Lockhart | 473/257 |
| 3,332,688 | A | * | 7/1967 | Gevertz | 473/265 |
| 3,471,155 | A | * | 10/1969 | Donaldson | 473/260 |
| 3,868,116 | A | * | 2/1975 | Ford et al. | 473/218 |
| 3,934,874 | A | * | 1/1976 | Henderson | 473/265 |
| D245,035 | S | * | 7/1977 | Gordon | D21/790 |
| 4,453,717 | A | * | 6/1984 | Solheim et al. | 473/265 |
| 5,131,659 | A | * | 7/1992 | Lindberg, Jr. | 473/267 |
| 5,209,484 | A | * | 5/1993 | Randall | 473/265 |
| 5,294,124 | A | | 3/1994 | Florian | 273/186.1 |
| 5,301,949 | A | * | 4/1994 | Aupied | 473/265 |
| 5,332,211 | A | * | 7/1994 | Rife et al. | 473/258 |
| 5,362,057 | A | * | 11/1994 | Arima | 473/265 |
| 5,393,065 | A | * | 2/1995 | LeQuyea | 473/260 |
| 5,429,368 | A | * | 7/1995 | Adams | 473/162 |
| 5,527,041 | A | * | 6/1996 | Terry et al. | 473/150 |
| 5,797,804 | A | * | 8/1998 | Chen | 473/260 |
| 6,019,685 | A | * | 2/2000 | Fonseca et al. | 473/265 |
| D436,639 | S | * | 1/2001 | Haliyo | D21/791 |

* cited by examiner

*Primary Examiner*—Gregory Vidovich
*Assistant Examiner*—Nini F. Legesse
(74) *Attorney, Agent, or Firm*—Frank J. Catalano

(57) ABSTRACT

An alignment guide for practice putting has a base with perpendicular target and putter face lines. An unobstructed gap extends away from the putter face line along the target line. A pair of guide rails are secured to the base in parallel relationship to and on opposite sides of the target line and spaced apart by a distance slightly greater than the distance from the toe to the heel of the putter head. The putter head can, therefore, move freely between, but be guided by, the rails. An adjustable stop limits the backswing of the putter head to allow comparison of the length of the backswing with the travel distance of the ball. An adjustable pair of stops simultaneously limiting travel of the toe and the heel of the putter head in the follow through confirm that the putter face has remained square to the target line.

14 Claims, 3 Drawing Sheets

ALIGNMENT GUIDE FOR PRACTICE PUTTING

BACKGROUND OF THE INVENTION

This invention relates generally to golf training equipment and more particularly concerns a guide for assisting a golfer to properly align the golfer's body and putter in preparation for and execution of a correct putting stroke.

Golfers have, for centuries, sought ways to lower their score. On a par 72, 18 hole course, 36 strokes are allotted for putting. The putter is the most used club in the golfer's bag. Improvement in putting skill is, therefore, a major contributor to significant improvement in golf scores. Over the years, two keys have come to be widely accepted as common to the mechanics of good putting. The putter face must be square to the target line and the putter head should be accelerating at the moment of impact with the ball.

There are techniques golfers can use to achieve the correct conditions at the moment of impact. For example, the longer the putting stroke maintains the putter head in a square condition, the more likely that the putter face will be square at the moment of impact. And the longer the follow-through in relation to the backswing, the more likely that the putter head will be accelerating at the moment of impact. Also, if the putting stroke is to be consistent, the position of the golfer in relation to the ball and the target line must be consistent. The clearer the reference lines, the easier it will be to maintain this consistency. It is easier, for example, to always position the golfer's eyes directly over the ball than to always position the golfer's eyes at some point which is not directly over the ball. It is also easier to always position the feet and shoulders on a line parallel to the target line than to always position the feet and shoulders at some angle which is not parallel to the target line.

It is, therefore, an object of this invention to provide an alignment guide for practice putting which facilitates consistent alignment of the golfer's putting stance in relation to a golf ball and a target line. Another object of this invention is to provide an alignment guide for practice putting which facilitates consistent alignment of the putter head position in relation to a golf ball and a target line. A further object of this invention is to provide an alignment guide for practice putting which structurally guides the putter head in a path parallel to the target line for a substantial portion of the backswing and follow-through. Yet another object of this invention is to provide an alignment guide for practice putting which structurally limits the backswing of the putting stroke to one of several distances selectable by the golfer. Yet another object of this invention is to provide an alignment guide for practice putting which structurally limits the follow-through of the putting stroke to one of several distances selectable by the golfer. It is also an object of this invention to provide an alignment guide for practice putting which provides feedback to the golfer as to whether the putter face has remained square to the target line during the follow-through. Still another object of this invention is to provide an alignment guide for practice putting which provides physical feedback to the golfer as to whether the putter face has opened in relation to the target line during the follow-through. An additional object of this invention is to provide an alignment guide for practice putting which provides physical feedback to the golfer as to whether the putter face has closed in relation to the target line during the follow-through. Another object of this invention is to provide an alignment guide for practice putting which has putter head guide rails which are adjustable in relation to each other so as to accommodate any configuration of putter head. A further object of this invention is to provide an alignment guide for practice putting which has putter head guide rails which are adjustable in relation to a target line so as to accommodate the putting style of the golfer.

SUMMARY OF THE INVENTION

In accordance with the invention, an alignment guide is provided for practicing striking a golf ball with a head of a putter. The guide has a base with perpendicular target and putter face lines which intersect at a point on an interior portion of the base. An unobstructed gap extends away from the putter face line along the target line from a beginning point which is less than a radius of a golf ball from the putter face line. A pair of guide rails are secured to the base. The rails are in parallel relationship to and on opposite sides of the target line and are spaced apart by a distance slightly greater than the distance from the toe to the heel of the putter head. The putter head can, therefore, move freely between, but be guided by, the rails. It is preferable that the guide rails and the gap be symmetrically arranged in relation to the target line, so that the same guide can be used by right or left handed golfers. It is also preferred that the gap have edges which diverge from their beginning point so that the guide will not impede or redirect the path of the ball after it is struck.

In one embodiment, the alignment guide includes a stop for limiting travel of the putter head from the putter face line away from the gap. This affords the golfer a visible mechanism for comparing the length of the backswing associated with the travel distance of the ball after it is struck. This can be accomplished, for example, by providing at least one aperture through a portion of the base on the opposite side of the putter face line as the gap and between the rails, with each aperture being sized to receive the stem of a golf tee. Preferably, the apertures are aligned on an axis parallel to the target line and are spaced at equal intervals. Most preferably, the aperture axis will be coincident with the target line. The golfer can thus insert a golf tee through a selected aperture into the ground, selection being based on the length of the putt.

In another embodiment, the alignment guide includes a pair of stops for simultaneously limiting travel of the toe and the heel of the putter head from the putter face line along the gap. The golfer will have physical confirmation that the putter face has remained square to the target line if the stops are simultaneously struck. This can be accomplished, for example, by providing at least one pair of apertures through the base on the same side of the putter face line as the gap and between the rails. Each pair of apertures straddles the gap and is aligned on an axis parallel to the putter face line. Each aperture is sized to receive the stem of a golf tee. Preferably, corresponding ones of the pairs of apertures are aligned on axes parallel to the target line and the pairs of apertures are spaced at equal intervals. Most preferably, the axes of corresponding ones of the pairs of apertures are symmetrically displaced from the target line. The golfer can thus insert tees through a selected pair of apertures into the ground, selection being based on the desired length of square follow-through for the putt.

Preferably, each of the guide rails is a length of angle iron with one flange of each angle iron biased against the base. For example, a pair of spring biased clamps can be extended through spaced apart apertures in the flange and through aligned slots in the base. The clamps are slidable in the slots against,the bias to position the rails. Thus, the rails can be permanently engaged against the base and manually slidable to a spacing that will accommodate any putter head with the golfer's desired ball contact point on the target line, yet sufficiently firmly engaged so as to not be shifted by any contact with the putter head.

The surface of the base on which the rails are disposed is preferably a mirror and the target and putter face lines are disposed on the mirror so as to give the golfer visual feedback as to positioning of the golfers head and shoulders in relation to the ball. At least one pair of parallel lines may also straddle the target line to facilitate parallel alignment of the rails. Preferably, the facilitating lines are symmetrically displaced form the target line.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
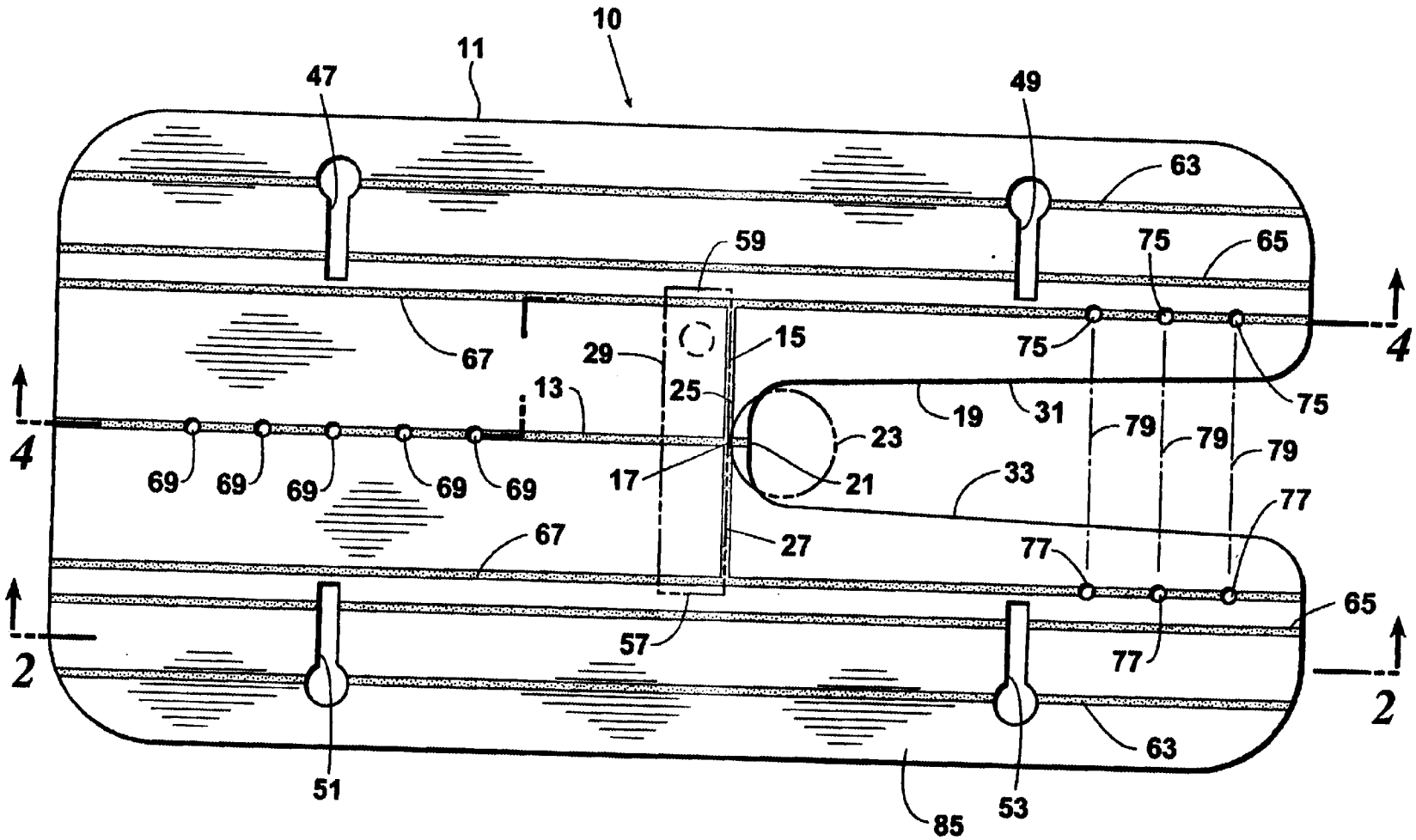
FIG. 1 is a top plan view of a preferred embodiment of the base of the alignment guide with a golf ball and putter head superimposed thereon.

Looking first to FIG. 1, a preferred embodiment of the alignment guide 10 is illustrated. The guide 10 has a flat, substantially rigid base 11 with perpendicular target and putter face lines 13 and 15 which intersect at a point 17 on an interior portion of the base 11. An unobstructed gap 19 extends away from the putter face line 15 along the target line 13 from a beginning point 21 which is less than a radius of a golf ball 23 from the putter face line 15. Thus, a golf ball 23 can rest; in the gap 19 with the intended point of contact 25 on the golf ball 23 being tangent to the face 27 of the putter head 29 when the face 27 is aligned on the putter faceline 15. It is preferred that the gap 19 be symmetrical in relation to the target line 13. It is also preferred that the gap 19 have edges 31 and 33 which diverge from the beginning point 21 of the gap 19 so as not to impede the travel of the ball 23 after it has been struck.

Figure 2:
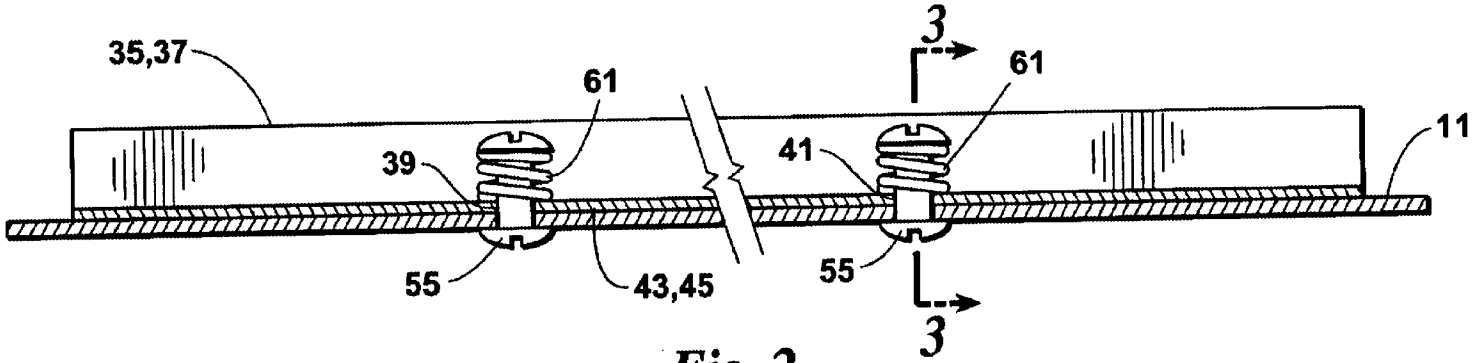
FIG. 2 is a cross-sectional view taken along the line 2—2 of FIG. 1 with a preferred embodiment of the guide rails secured thereon.
Figure 3:
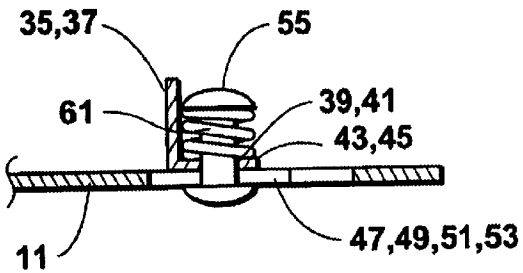
FIG. 3 is a cross-sectional view taken along the line 3—3 of FIG. 2.

Looking at FIGS. 1, 2 and 3, the guide also includes a pair of guide rails 35 and 37. Each of the guide rails 35 and 37 is preferably a length of angle iron with a pair of apertures 39 and 41 spaced apart in one of its flanges 43 or 45. As shown in FIG. 1, the base 11 has four key-hole shaped slots 47, 49, 51 and 53 which are longitudinally aligned in pairs parallel to the putter face line 15 and spaced apart along the length of the base 11. Looking at FIGS. 2 and 3, the guide 10 also has a plurality of clamps 55 which are adapted to secure the guide rails, 35 and 37 against the base 11. The positioning of the slots 47, 49, 51 and 53 in the base 11 is such as to permit the guide rails 35 and 37 to be secured to the base 11 parallel to and on opposite sides of the target line 13 with the rails 35 and 37 spaced apart by a distance slightly greater than a distance from a toe 57 to a heel 59 of the putter head 29. The clamps 55 are preferably rivet-like members with a compression spring 61 between the opposite heads of the rivet 55. The rivets 55 extend through the apertures 39 and 41 in the guide rail flanges 43 and 45 with the springs 61 on the interior portion of the angle iron guide rails 35 and 37.

Figure 4:
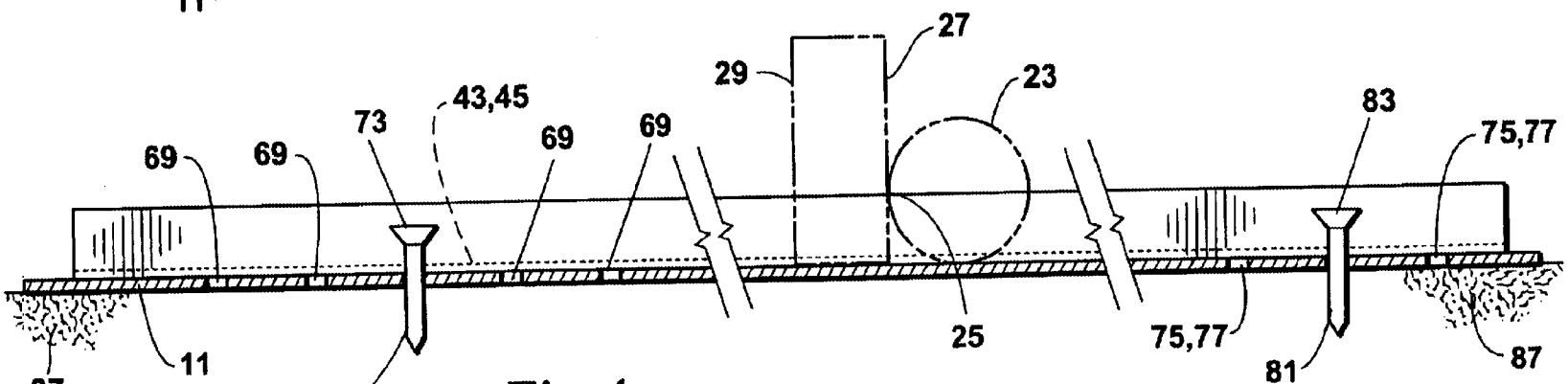
FIG. 4 is a cross-sectional view taken along the line 4—4 of FIG. 1 with the guide rails of FIG. 2 and the backswing and follow through stops added.

As shown in FIG. 4, the apertured flanges 43 and 45 of the guides 35 and 37 can be aligned on the key hole shaped slots 47, 49, 51 and 53 with the heads of the respective rivets 55 aligned with the circular portions of the slots 47, 49, 51 and 53. The rivets 55 can then be pressed against the bias of the spring 61 so that one head of each rivet 55 passes through the round portion of its slot 47, 49, 51 and 53. The damp or rivet 55 can then be slid into the narrower portions of the slots 47, 49, 51 and 53 and released to bias so that the bias of the springs 61 presses the apertured flanges 43 and 45 against the surface of the base 11. In this condition, the clamps 55 are manually slidable in the slots against bias by a significant force to reposition the rails 35 and 37 as desired on the base 11. To facilitate proper alignment of the guide rails 35 and 37 at least one and, as shown, three pairs of parallel lines 63, 65 and 67 straddle the target line 13. As shown, it is preferred that these facilitating lines 63, 65 and 67 be symmetrically displaced from the target line 13.

Figure 5:
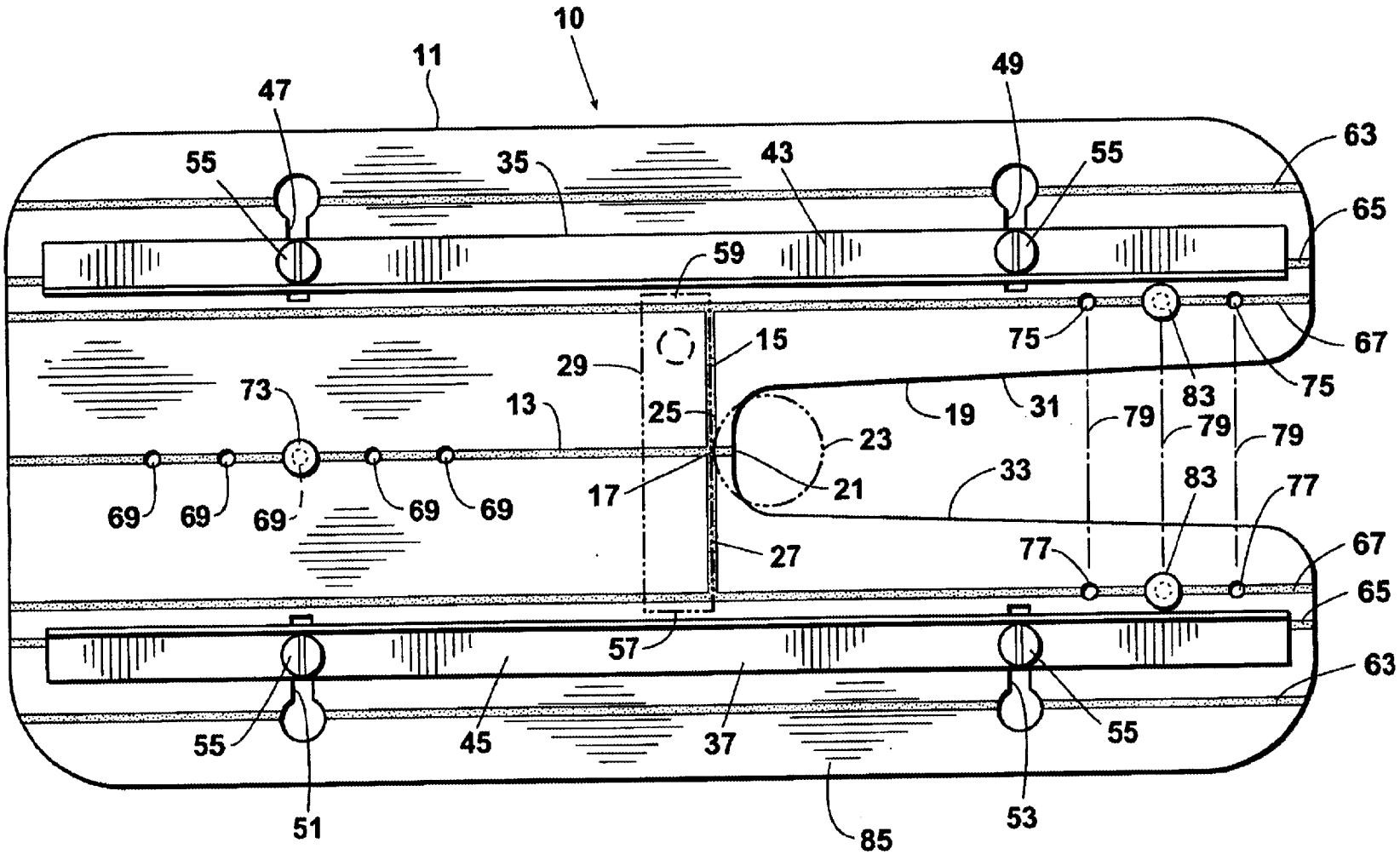
FIG. 5 is a top plan view of a preferred embodiment of the guide base, rails and stops with a golf ball and putter head superimposed thereon.

Looking again at FIG. 1, the base is also provided with at least one and as shown five apertures 69 which extend through the portion of the base 11 which is on the opposite side of the putter face line 15 as the gap 19. The apertures 69 are aligned between the guide rails 35 and 37, preferably on an axis parallel to the target line 13 and most preferably on the target line 13. It is also preferable that they be spaced at equal intervals. As best seen in FIG. 5, each of the apertures 69 is sized so as to receive the stem 71 of a golf tee 73 therein. As seen in FIG. 5, the tee 73 will limit the length of the backstroke of the putter head 29. The golfer can insert the tee 73 in a selected one of the apertures 69 depending on the intended length of the putt to be practiced.

As also seen in FIG. 5, pairs of apertures 75 and 77, as shown three pairs, extend through the base 11 on the same side of the putter face line 15 as the gap 19 and between the rails 35 and 37. Each pair of apertures 75 and 77 straddles the gap 19 and is aligned on an axis 79 which is parallel to the putter face line 15. As best seen in FIG. 5, each of the apertures 75 and 77 is also sized to receive a stem 79 of a golf tee 83 therein. As shown, corresponding ones of the pairs of apertures 75 and 77 are aligned on one of the pairs of facilitating lines 67. This pair of lines 67 is proximate the outer extremities of, but within the face 27 of the putter head 29. Also as shown, the axes 79 are preferably spaced at equal intervals and the apertures 75 and 77 are symmetrically displaced from the target line 13. Thus, the follow-through of the putter head 29 will be limited by contact with the tees 83 inserted through pairs of apertures 75 and 77 on a selected axis 79. More importantly, as the face 27 of the putter head 29 comes into contact with the tees 83, the golfer will receive feedback as to whether the face 27 of the putter head 29 has remained square to the target line 13. If the putter head 29 contacts both tees 75 and 77 simultaneously, then the face 27 is square. If the face 27 first contacts the tee 83 closest to the golfer, then the putter face 27 has been opened. If the face 27 first contacts the furthermost tee 83, then the putter face 27 has been closed.

Preferably, the surface of the base 11 against which the guide rails 35 and 37 are secured is a mirror 85 with the target line 13, putter face line 15, and pairs of facilitating lines 63, 65 and 67 disposed on the mirror 85.

In use, the golfer places the head 29 of his putter on the mirrored surface with the desired contact point of the putter face 27 aligned on the target line 13 and the putter face 27 aligned on the putter face line 15. The golfer then slides the guide rails 35 and 37 into a parallel condition spaced approximately ¼ inch outside of the toe 57 and heel 59 of the putter head 29. It should be noted that, while it is preferred that the positioning of the putter head 29 is such that the rearmost point on the ball 23 will be centered on the putter face 27, some golfers may prefer to strike the ball 23 on the putter face. 27 at a point closer to the toe 57 or heel 59 of the putter head 29. The guide 10 permits such an adjustment, the guide rails 35 and 37 simply being adjusted so as not to be symmetrically displaced from the target line 13. With the rails 35 and 37 properly spaced, the golfer selects a target (not shown) and positions a golf ball 23 at any desired distance from the target. The golfer then lays the guide 10 on the ground 87 with the mirror surface 85 up. The guide 10 is positioned with the ball resting on the ground 87 in the gap 19 of the base 11 with the contact point 25 of the ball 23 centered on the target line 13 and tangent to the putter face line 15. Given the selected distance to the target (not shown), the golfer then chooses the desired limit for the backswing of the putter head 29 and inserts a golf tee 73 into the selected aperture 69. The golfer also selects the desired length for the square follow through and inserts a pair of golf tees 83 into the apertures 75 and 77 aligned on the axis 79 which is closest to the point of this square follow through. The golfer then assumes a putting stance by aligning the feet and shoulders (not shown) in relation to the target line 13 or any of the parallel lines 63, 65 or 67 and by positioning the eyes directly over the ball 23. The mirror surface 85 assists the golfer in confirming the proper positioning of the shoulders and eyes. The putter head 29 is inserted between the guide rails 35 and 37 with the face 27 aligned with the putter face line 15. The direction of the backswing and follow-through are limited by the guide rails 35 and 37 and the length of the backswing is determined by the golf tee 73 while the length of the square portion of the followthrough is determined by the golf tees 83. After several putts at a given target (not shown), the golfer can adjust the alignment of the target line 13 or change the apertures in which the golf tees 73 and 83 are inserted so as to achieve the proper stroke. With continued practice, the golfer can correlate the length of the backswing and follow through to desired putt distances.

In a satisfactory prototype, the base 11 is an approximately 18 inches long by 9 inches wide by ⅛ inch thick laminated acrylic mirror. Five backswing limiting apertures 69 are spaced on one inch centers on the target line 13 beginning two inches from the back edge of the base 11. Three pairs of follow through limiting apertures 75 and 77 are spaced on one inch centers one inch from the front edge of the base 11. The putter face line 15 is approximately 8¼ inches from the front edge of the base 11 and the beginning point 21 of the gap 19 is approximately ¼ inch forward of the putter face line 15. The slots 47, 49, 51 and 53 are spaced along the length of the base 11 by a distance of ten inches. The numbers of and spacing of apertures 69 and 75 and 77 may vary. The number of pairs of alignment facilitating lines 63, 65 and 67 may be varied. In the prototype, it was found desirable to color code the alignment facilitating lines 63, 65 and 67 and the target line 13 for the convenience of the golfer in positioning the guide rails 35 and 37.

Thus, it is apparent that there has been provided, in accordance with the invention, an adjustment guide for practice putting that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. An alignment guide for practicing striking a golf ball with a head of a putter comprising a base having perpendicular target and putter face lines intersecting at a point on an interior portion of said base and an unobstructed gap extending away from said putter face line along said target line from a beginning point spaced from and less than a radius of a golf ball from said putter face line, a pair of guide rails and means for securing said guide rails on said base in parallel relationship to and on opposite sides of said target line with said rails spaced apart by a distance slightly greater than a distance from a toe to a heel of the putter head and at least one aperture through said base, each said aperture being on an opposite side of said putter face line as said rap and between said rails, each said aperture being sized to receive a stem of a golf tee therethrough with a bottom tip of said tee extending below said base and a top of said tee extending above said base in a path of back swing of the putter head, said apertures being coincident with said target line.

2. An alignment guide according to claim 1, said securing means being adaptable for positioning said guide rails in symmetrical relationship to said target line.

3. An alignment guide according to claim 2, said gap being symmetrical in relation to said target line.

4. An alignment guide according to claim 1, said apertures being spaced at equal intervals.

5. An alignment guide according to claim 1 further comprising means on said base for simultaneously limiting travel of the toe and heel of the putter head from said putter face line along said gap.

6. An alignment guide according to claim 1 further comprising at least one pair of apertures through said base on a same side of said putter face line as said gap and between said rails, each said pair of apertures straddling said gap and being aligned on an axis parallel to said putter face line, each said aperture being sized to receive a stem of a golf tee therethrough with a bottom tip of said tee extending below said base and a top of said tee extending above said base in a path of follow through of the putter head.

7. An alignment guide according to claim 6, corresponding apertures of said pairs of straddling apertures being aligned on a pair of axes parallel to and straddling said target line.

8. An alignment guide according to claim 7, said pairs of apertures being spaced at equal intervals.

9. An alignment guide according to claim 7, said axes of corresponding ones of said pairs of apertures being symmetrically displaced from said target line.

10. An alignment guide for practicing striking a golf ball with a head of a putter comprising a base having perpendicular target and putter face lines intersecting at a point on an interior portion of said base and an unobstructed gap extending away from said gutter face line along said target line from a beginning point spaced from and less than a radius of a golf ball from said putter face line, a pair of guide rails and means for securing said guide rails on said base in parallel relationship to and on opposite sides of said target line with said rails spaced apart by a distance slightly greater than a distance from a toe to a heel of the putter head, each of said guide rails comprising a length of angle iron and said securing means comprising means for biasing one flange of each said angle iron against said base.

11. An alignment guide according to claim 10, each said biasing means comprising a pair of spring biased clamps extending through spaced apart apertures in said one flange and aligned slots through said base, said clamps being slidable in said slots against said bias to position said rails.

12. An alignment guide according to claim 10, a surface of said base on which said rails are disposed being a mirror and said target and putter face lines being disposed on said mirror.

13. An alignment guide according to claim 10 further comprising at least one pair of parallel lines straddling said target line for facilitating parallel alignment of said rails.

14. An alignment guide according to claim 13, said facilitating lines being symmetrically displaced from said target line.

* * * * *